US005645086A

United States Patent [19]

Brand et al.

[11] Patent Number: 5,645,086

[45] Date of Patent: Jul. 8, 1997

[54] APPARATUS FOR EVACUATING SURPLUS AIR FOR THE DISTRIBUTOR OF A TOBACCO PROCESSING MACHINE

[75] Inventors: Peter Brand, Hamburg; Andreas Ducci, Escheburg; Wolfgang Steiniger, Börnsen, all of Germany

[73] Assignee: Hauni Maschinenbau AG, Hamburg, Germany

[21] Appl. No.: 597,700

[22] Filed: Feb. 6, 1996

[30] Foreign Application Priority Data

Mar. 8, 1995 [DE] Germany ..... 195 08 139.0

[51] Int. Cl.[6] ..... A24C 5/18

[52] U.S. Cl. ..... 131/84.3; 131/108; 131/109.2; 131/110

[58] Field of Search ..... 131/109.1, 109.2, 131/84.1, 84.2

[56] References Cited

U.S. PATENT DOCUMENTS 4,463,768 8/1984 Quarella ..... 131/84.3
4,610,260 9/1986 Heitmann ..... 131/84.3
5,072,742 12/1991 Heitmann ..... 131/84.3
5,148,816 9/1992 Heitmann ..... 131/84.3

FOREIGN PATENT DOCUMENTS 42 40 459 A1 6/1994 Germany ..... 131/84.3

*Primary Examiner*—V. Millin
*Assistant Examiner*—Charles W. Anderson
*Attorney, Agent, or Firm*—Darby & Darby

[57] ABSTRACT

The distributor of a cigarette rod maker has a chamber bounded at least in part by a concave guide for a flow of fragments of smokable material in a stream of transporting fluid, such as air. The stream contains a surplus which is withdrawn from a centrally located zone of the chamber by a stationary apparatus having at its underside an inlet for the entry of surplus fluid and containing a nozzle which conveys the surplus fluid to a suction pipe serving to convey the surplus from the chamber.

5 Claims, 1 Drawing Sheet

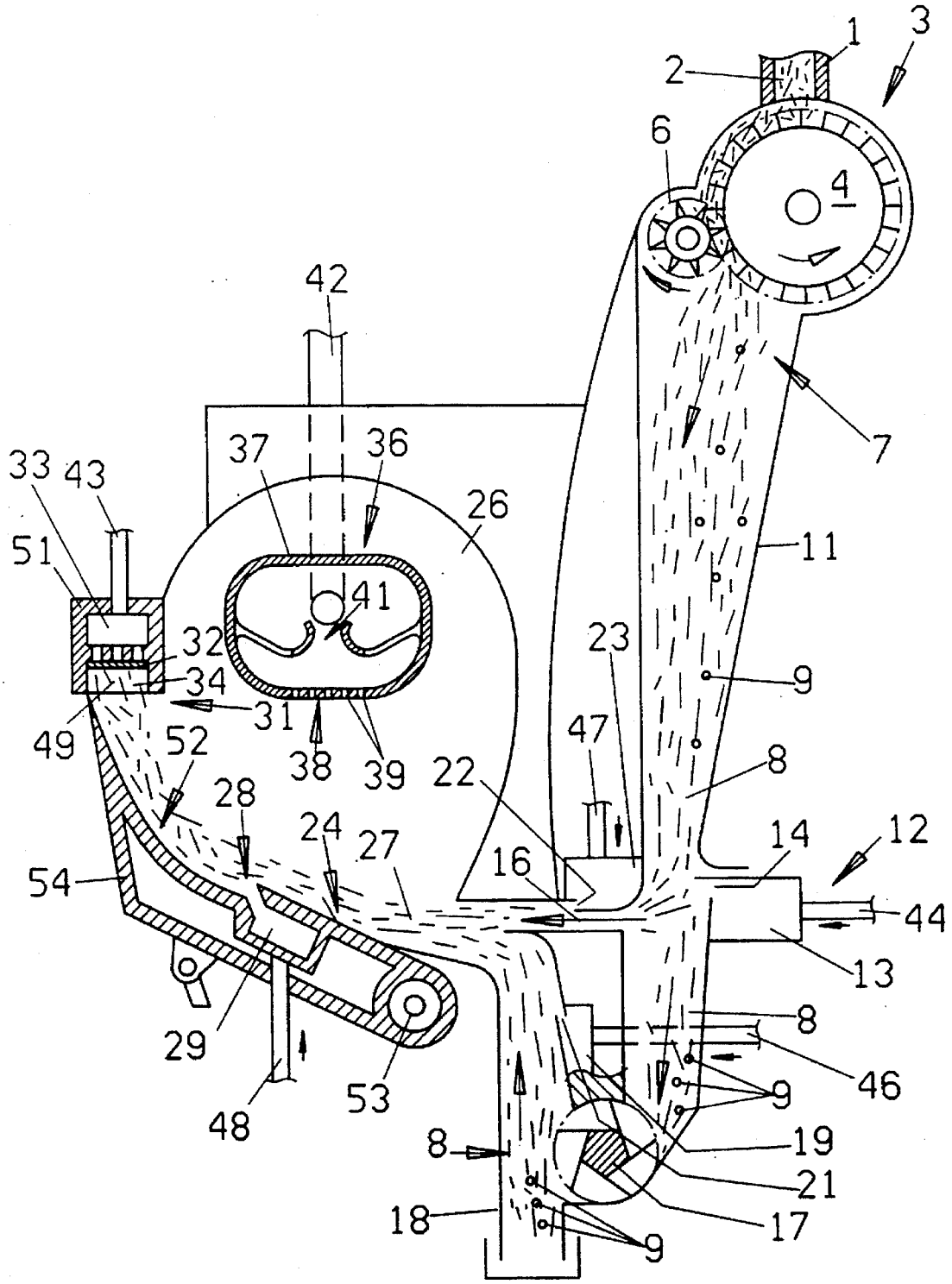
1
2
3
4
6
7
8
9
11
12
13
14
16
17
18
19
21
22
23
24
26
27
28
29
31
32
33
34
36
37
38
39
41
42
43
44
46
47
48
49
51
52
53
54

APPARATUS FOR EVACUATING SURPLUS AIR FOR THE DISTRIBUTOR OF A TOBACCO PROCESSING MACHINE

BACKGROUND OF THE INVENTION

The invention relates to improvements in machines for the making of rod-like fillers containing fragments of tobacco and/or other smokable material. More particularly, the invention relates to improvements in apparatus for evacuating surplus air from a chamber in a distributor (also called hopper) of a machine for the making of plain cigarettes, cigars, cigarillos or other rod-shaped smokable articles of the tobacco processing industry.

Surplus air evacuating apparatus of the character to which the present invention pertains are often utilized in a chamber wherein a flow of fragments of smokable material is conveyed in a stream of gaseous fluid (normally air an hereinafter referred to as air for short) and which is bounded at least in part by a concave surface of a guide. The flow is caused to advance along the concave surface of the guide in a direction from the location where the flow (in an air stream) enters the chamber to a location where the flow leaves the chamber in order to be converted into one or more rod-like fillers ready to be drapped into one or more webs of cigarette paper or other suitable wrapping material. It is often necessary to accelerate the flow of fragmentized smokable material by causing the flow to advance with at least one stream of compressed air. Such stream is or can be circulated along an at least partially closed path, and the surplus of air must be evacuated from such quasi closed path. It is particularly important to regulate the quantity of air in a tobacco conveying system which operates primarily, predominantly or exclusively with compressed air or by suction. Typical examples of such conveying systems are those utilized in the so-called fluidized bed distributors or hoppers of cigarette rod making machines wherein one or more flows of fragments of smokable material are caused to advance along the concave surface of a guide and wherein such surface is provided with orifices for jets or streamlets of compressed air flowing in the general direction of desired transport of fragments of smokable material.

Commonly owned U.S. Pat. No. 5,148,816 granted Sep. 22, 1992 to Heitmann for "Method of and apparatus for making a tobacco stream with a core containing tobacco ribs" discloses a distributor or hopper wherein the upper portion of the wall bounding the chamber for transport of a flow of tobacco particles is perforated to permit the escape of surplus air.

Commonly owned U.S. Pat. No. 4,463,768 granted Aug. 7, 1984 to Quarella for "Apparatus for forming a tobacco filler" discloses a distributor wherein the surplus of air is evacuated through radial bores or holes provided in a rotary drum-shaped conveyor.

OBJECTS OF THE INVENTION

An object of the invention is to provide a simple, compact and inexpensive apparatus which can evacuate surplus air from the distributor or hopper of a machine for the making of rods consisting of or containing smokable material.

Another object of the invention is to provide an apparatus which can be installed in existing distributors as a superior substitute for conventional surplus air evacuating apparatus.

A further object of the invention is to provide an apparatus which requires a minimum of maintenance and which is more reliable than heretofore known apparatus.

An additional object of the invention is to provide a distributor or hopper embodying the above outlined improved surplus air evacuating apparatus.

Still another object of the invention is to provide a novel and improved method of evacuating surplus air from a chamber of a distributor in a cigarette rod making machine.

A further object of the invention is to provide an apparatus which can evacuate surplus air in such a way that the evacuated air contains a much lower percentage of solids than the air which is being evacuated by resorting to heretofore known apparatus.

Another object of the invention is to provide an apparatus which is more acceptable to environmental protection and health authorities than conventional surplus air evacuating apparatus.

An additional object of the invention is to provide an apparatus which is constructed and assembled in such a way that the distributor or hopper embodying the apparatus can operate satisfactorily without expensive and readily clogged filters.

Still another object of the invention is to provide an apparatus which can evacuate air in such a way that the thus evacuated air can be immediately reintroduced into a distributor without any additional filtering and/or other time-consuming and expensive treatment.

SUMMARY OF THE INVENTION

The invention resides in the provision of an apparatus for evacuating surplus air from a chamber having a substantially centrally located section or zone and being bounded at least in part by a substantially concave guide for the advancement of a mixture of air (including surplus air) and fragments of smokable material in the chamber toward a unit for the building or forming of a filler of smokable material. The improved apparatus comprises a pneumatic air withdrawing device which is disposed at least in part in or at the substantially centrally located zone of the chamber and includes means for withdrawing surplus air from the chamber by suction.

The air withdrawing device is or can be stationary. Such device can comprise a substantially tubular member having an upper side confronting a top portion of the chamber and an underside facing away from the top portion of the chamber and having at least one inlet for the flow of surplus air from the chamber into the tubular member of the surplus air withdrawing device. Otherwise stated, the air withdrawing device can be said to include a substantially tubular member having an underside provided with at least one inlet for the flow of surplus air from the chamber into the tubular member. The at least one inlet can include at least one sieve which intercepts smokable material and has orifices for the passage of surplus air from the chamber into the tubular member. The arrangement can be such that the tubular member includes a central portion above the inlet or inlets and the surplus air withdrawing device further comprises a nozzle defining for the surplus air a path which narrows, at least in part, in a direction from the at least one inlet toward the central portion of the tubular member.

The chamber and the unit can form part of a so-called distributor or hopper in a tobacco rod making machine, e.g., in a cigarette maker.

The guide can slope upwardly from a lower level (e.g., a level where the smokable material enters the chamber) to a higher level which is or which can be the level of the surplus air withdrawing device and/or the filler forming or building unit.

The novel features which are considered as characteristic of the invention are set forth in particular in the appended claims. The improved surplus air evacuating apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a partly elevational and partly vertical sectional view of a distributor or hopper forming part of a cigarette rod making machine and having a chamber which accommodates a surplus air evacuating apparatus embodying one form of the present invention.

DESCRIPTION OF PREFERRED EMBODIMENTS

The distributor or hopper (hereinafter called distributor) which is shown in the drawing is similar to those utilized in certain types of cigarette rod making machines known as PROTOS and distributed by the assignee of the present application. The manner in which a duct 1 of the distributor receives tobacco particles from a suitable source and the manner in which the stream of fragmentized smokable material leaving the distributor is converted into a continuous cigarette rod form no part of the present invention. Reference may be had, for example, to the commonly owned published German patent application Serial No. 42 40 459 and/or to commonly owned U.S. Pat. No. 5,072,742 granted Dec. 17, 1991 to Heitmann for "Method of and apparatus for making a filler of smokable material". The disclosures of all U.S. patents mentioned in the present application are incorporated herein by reference.

The duct 1 supplies a continuous column 2 of a mixture of lighter tobacco particles 8 (e.g., shreds of tobacco leaf laminae) and heavier tobacco particles 9 (e.g., fragments of tobacco ribs) into the range of a tobacco withdrawing and tobacco shower forming unit 3 which is located at the lower end of the duct 1 and comprises a rotary carded drum 4 cooperating with a rapidly rotating picker roller 6. The pins or needles of the picker roller propel the particles 8, 9 from the carding of the drum 4 into a downwardly extending and downwardly tapering gravity duct or channel 11 wherein the particles form a shower 7 descending into a deflecting zone 12. At least a majority of the lighter particles 8 are deflected in the direction of arrow 16 by one or more nozzles 14 receiving compressed air from a plenum chamber 13 which is connected to a compressed air source (not specifically shown) by one or more supply conduits 44. The jet or jets of compressed air issuing from the nozzle or nozzles 14 advance transversely of the direction of downward movement of the shower 7, and such jet or jets are sufficiently strong to expel from the shower 7 at least the major percentage of lighter particles 8 while permitting the heavier particles 9 to descend beyond the plenum chamber 13 into the range of a rotary cell wheel type gate 17. The latter transfers the heavier particles 9, as well as any lighter particles 8 which are entrained by the heavier particles, downwardly and beyond the nozzle or nozzles 14, into the lower portion of an upright sifting duct 18.

The heavier particles 9 descend in the sifting duct 18 by gravity to enter a collecting receptacle or to decend onto a suitable conveyor (not shown) but the lighter particles 8 which have entered the duct 18 by way of the gate 17 are caused to rise due to the injector effect of one or more nozzles 21 which admit into the sifting duct 18 one or more streamlets of compressed air in an upward direction so that the lighter particles 8 (if any) in the duct 18 are caused to rise and to merge into the flow of lighter particles 8 advancing from the deflecting zone 12 under the action of the jet or jets of compressed air issuing from the nozzle(s) 14. The nozzle or nozzles 21 receive compressed air from a plenum chamber 19 which, in turn, receives compressed air from the aforementioned source (or from another source) by way of one or more supply conduits 46. The advancement of lighter particles 8 from the shower 7 in the direction indicated by the arrow 16 (and of the lighter particles 8 which have risen in the sifting duct 18) is or can be assisted by one or more optional additional nozzles 22 receiving compressed air from a plenum chamber 23 which, in turn, receives compressed air from the aforementioned source (or from another suitable source) by way of one or more supply conduits 47.

The combined flow 27 of lighter particles 8 advancing beyond the nozzles 21 and 22 is caused to advance along an upwardly sloping path which is defined by the concave surface of a suitable guide 24 bounding the lower portion of a distributor chamber 26. The thickness of the flow 27 of lighter particles 8 is exaggerated in the drawing for the sake of clarity. Such flow consists of a relatively loose layer of discrete lighter particles 8 in carrier fluid consisting of compressed air. The flow and the carrier fluid closely follow the outline of the concave surface of the guide 24, and their advancement along the path defined by the guide 24 is or can be assisted by one or more streamlets or jets of compressed air issuing from one or more nozzles 28 provided in the guide 24. The nozzle or nozzles 28 receive compressed air from a plenum chamber 29 which, in turn, receives compressed air from the aforementioned source (and/or from another suitable source) by way of one or more supply conduits 48. The illustrated nozzle 28 can be located nearer to or further away from the duct 18, and it is equally possible to provide the distributor (e.g., its guide 24) with two or more nozzles performing the function of the nozzle 28 and being disposed at different distances from the sifting duct 18 to ensure a highly predictable advancement of the flow 27 in the lower potion of the distributor chamber 26.

Successive increments of the flow 27 enter a stream building unit 31 which includes an endless foraminous conveyor 32 having a lower reach disposed beneath a suction chamber 33. The latter attracts the ascending lighter particles 8 to the underside of the lower reach of the conveyor 32 so that particles 8 form a continuous stream 34 advancing in a direction at right angles to the plane of the drawing. Such stream is relieved of surplus tobacco by a so-called trimming or equalizing device and the thus obtained rod-like filler is draped into a web of cigarette paper or other suitable wrapping material, all in a manner well known in the art of cigarette making and not forming part of the present invention.

The nozzles 14, 21, 22 and 28 supply compressed air in such quantities that the distributor chamber 26 contains a surplus of compressed air, and such surplus is evacuated or withdrawn from the chamber 26 by an apparatus 36 (constituting a stationary air withdrawing device) which embodies one presently preferred form of the invention. The apparatus 36 is disposed at least close to a substantially centrally located portion or zone of the distributor chamber 26 and includes a tubular member 37 having an upper side confronting and spaced apart from the concave underside of the top portion of the chamber 26. The underside of the tubular member 37 (namely that side which faces away from the top portion of the chamber 26 and confronts the flow 27 of lighter particles 8 at the concave surface of the guide 24) is provided with at least one inlet 38 which permits surplus air to flow from the chamber 26 into the tubular member 37 on its way out of the distributor. The inlet 38 can constitute a simple filter having orifices 39 which are sufficiently small to enable the filter to intercept the tobacco particles 8 but to permit surplus air to leave the chamber 26 on its way into an upwardly tapering or converging slotted nozzle 41 in the central portion of the tubular member 37. The nozzle 41 defines for surplus air a path which narrows, at least in part, in a direction from the inlet 38 toward the central portion of the tubular member 37. The tubular member 37 and the nozzle 41 preferably extend across the full width of the distributor chamber 26 (as measured at right angles to the plane of the drawing).

The means for withdrawing surplus air from the tubular member 37 (i.e., from the improved apparatus and from the chamber 26) comprises at least one suction pipe 42 connected to the suction intake of a suitable blower, not shown. The suction intake of the blower is or can be further connected to a suction pipe 43 which serves to draw air from the suction chamber 33 forming part of the stream building unit 31. The pressure side of the just discussed blower can be connected to the aforementioned supply conduits 44, 46, 47, 48 serving to supply compressed air to the nozzles 14, 21, 22 and 28, respectively, i.e., to the plenum chambers 13, 19, 23 and 29.

The foraminous conveyor 32 of the stream building unit 31 is installed in an elongated tobacco channel 49 having sidewalls 51 flanking the conveyor 32 and the suction chamber 33. The upper end portion 52 of the guide 24 directs successive increments of the flow 27 into the channel 49 beneath the underside of the lower reach of the conveyor 32 (the upper reach of this conveyor is not shown in the drawing) in such a way that the guide 24 ensures a smooth and predictable transfer of lighter tobacco particles 8 forming the flow 27 from the interior of the distributor chamber 26 into the channel 49. In order to afford convenient access to the surplus air evacuating apparatus 36 in the chamber 26, the housing 54 of the guide 24 is pivotably mounted in the distributor, as at 53. Such mounting of the guide 24 renders it possible to avoid lengthy stoppages of the distributor and of the cigarette rod making machine in which the distributor is put to use.

The operation of the distributor and of its stationary surplus air evacuating apparatus 36 is as follows:

Lighter tobacco particles 8 forming part of the shower 7 in the duct 11 are deflected by the jet or jets of compressed air issuing from the nozzle or nozzles 14 so that they are propelled in the direction of arrow 16, i.e., onto the concave upper side or surface of the pivotable guide 24. Thus, the nozzle or nozzles 14 carry out a desirable and highly reliable classifying or sifting action by segregating the lighter particles 8 from the heavier particles 9 which descend toward and are transferred into the sifting duct 18 by the rotating gate 17. The mixture of lighter particles 8 deflected by the nozzle or nozzles 14 and lifted by the nozzle or nozzles 21 forms the flow 27 which is caused to move along an upwardly sloping path from the level of the deflecting zone 12 to the level of the stream building unit 31 and air evacuating apparatus 36. The particles 8 of the flow 27 are attracted to the underside of the lower reach of the conveyor 32 under the action of the suction chamber 33 so that such particles form a continuous stream 34 which is advanced past the aforementioned trimming or equalizing device and into the wrapping mechanism of the cigarette rod making machine embodying the improved distributor and its surplus air evacuating apparatus 36. The wrapping mechanism includes means for bonding the overlapping marginal portions of the properly draped web to each other so that the web forms a tube which surrounds the rod-like filler consisting of the lighter tobacco particles 8. The cigarette rod is caused to pass through a so-called cutoff which subdivides the rod into a file of discrete plain cigarettes of unit length or multiple unit length.

An important advantage of the apparatus 36 is that it is capable of reliably preventing the escape of any solid particles (or any significant amounts of solid particles) from the chamber while simultaneously permitting the surplus air to leave the chamber 26 for admission into the surrounding atmosphere or for recirculation through the distributor, i.e., for return flow to the inlet or intake of the aforementioned blower (or an analogous source of compressed air) which serves to supply compressed air to the conduit 44, 46, 47 and/or 48. The solid particles which are intercepted at the inlet 38 of the tubular member 37 are returned into the flow 27 and the thus cleaned or sifted surplus air is free to advance through the orifices 39, through the nozzle 41 and into the conduit 42.

Solid particles which float in the chamber 26 and are acted upon by centrifugal force deposit at the concave inner side of the chamber 26 and move therealong until they reach or return into the flow 27 for advancement toward and into the channel 49. Such solid particles can include minute fragments of tobacco particles 8 and/or tobacco dust. The just described mode of circulation of solid particles in the chamber 26 ensures that the centrally located zone of this chamber is at least substantially free of solid particles to thus guarantee practically unobstructed penetration of surplus air into the tubular member 37.

An important advantage of the feature that the inlet 38 is provided at the underside of the tubular member 37 is that, when the operation of the rod making machine is interrupted for whatever reason (e.g., due to the so-called flow stoppers), any solid particles which happen to be adjacent the underside of the top portion of the chamber 26 and are free to descend in response to a stoppage of the machine cannot clog the orifices 39 of the inlet 38 so that the apparatus 36 is ready for use as soon as the machine is restarted.

The provision of a tubular member 37 and an orifice 41 which extend all the way across the distributor chamber 26 (as measured at right angles to the plane of the drawing) exhibits the advantage that the evacuation of surplus air is at least substantially uniform all the way across the chamber.

To summarize: The improved apparatus 36 and its equivalents exhibit the important advantage that the surplus air can be readily, reliably and predictably segregated from tobacco particles and tobacco dust and that such desirable segregation can take place in the distributor chamber 26 so that the segregated solid material can enter or reenter the flow 27 for introduction into the channel 49, i.e., into the tobacco stream 34. Moreover, the thus cleaned surplus air can be readily admitted into the surrounding atmosphere or reused for controlled advancement of tobacco particles from the deflecting zone 12 into the chamber 26 and thence into the channel 49. Still further, such desirable highly satisfactory segregation of solid particles from surplus air in the chamber 26 can be achieved without resorting to complex, expensive and readily clogged special filters which must be cleaned or replaced at frequent intervals.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for evacuating surplus air from a chamber having a substantially centrally located zone and being bounded at least in part by a substantially concave guide for the advancement of a mixture of air and fragments of smokable material in the chamber toward a unit for the building of a filler of smokable material, comprising a stationary pneumatic air withdrawing device disposed at least in part in said substantially centrally located zone of said chamber and including means for withdrawing surplus air from the chamber by suction, said device including a substantially tubular member having an upper side confronting a top portion of said chamber and an underside facing away from said top portion and having at least one inlet for the flow of surplus air from said chamber into said tubular member.

2. The apparatus of claim 1, wherein said at least one inlet includes a sieve which intercepts smokable material and has orifices for surplus air.

3. The apparatus of claim 1, wherein said tubular member has a central portion above said at least one inlet and said air withdrawing device further comprises a nozzle defining for the surplus air a path which narrows, at least in part, in a direction from said at least one inlet toward said central portion.

4. The apparatus of claim 1, wherein said chamber and said unit form part of a distributor in a tobacco rod making machine.

5. The apparatus of claim 1, wherein said guide slopes upwardly from a lower level to a higher level of at least one of said air withdrawing device and said unit.

* * * * *